US010596685B2

(12) United States Patent
Lee

(10) Patent No.: US 10,596,685 B2
(45) Date of Patent: Mar. 24, 2020

(54) ENGAGING PORTION FOR A HAND TOOL

(71) Applicant: Tsan-Chang Lee, Taichung (TW)

(72) Inventor: Tsan-Chang Lee, Taichung (TW)

( * ) Notice: Subject to any disclaimer, the term of this patent is extended or adjusted under 35 U.S.C. 154(b) by 301 days.

(21) Appl. No.: 15/871,954

(22) Filed: Jan. 15, 2018

(65) Prior Publication Data

US 2019/0217449 A1 Jul. 18, 2019

(51) Int. Cl.
*B25B 13/06* (2006.01)
*B25B 23/00* (2006.01)
*B25B 13/46* (2006.01)

(52) U.S. Cl.
CPC ..... *B25B 13/065* (2013.01); *B25B 23/0014* (2013.01); *B25B 23/0035* (2013.01); *B25B 13/463* (2013.01)

(58) Field of Classification Search
CPC .... B25B 23/0035; B25B 13/065; B25B 13/04
See application file for complete search history.

(56) References Cited

U.S. PATENT DOCUMENTS 4,126,063 A * 11/1978 Palmer ..... B25B 13/065 81/124.6
5,832,792 A * 11/1998 Hsieh ..... B25B 13/065 81/124.6
6,098,501 A * 8/2000 Sundstrom ..... B25B 13/04 81/119
7,168,347 B2 * 1/2007 Hsieh ..... B25B 13/04 81/120
7,261,020 B2 * 8/2007 Hsieh ..... B25B 13/04 81/121.1
7,661,339 B2 * 2/2010 Wu ..... B25B 13/065 81/119
8,056,449 B2 * 11/2011 Hsieh ..... B25B 13/065 81/121.1
8,869,660 B2 * 10/2014 Hsieh ..... B25B 13/04 81/119
2004/0255728 A1 * 12/2004 Hsieh ..... B25B 13/04 81/186
2009/0007732 A1 * 1/2009 Hsieh ..... B25B 13/04 81/120
2009/0235788 A1 * 9/2009 Hsieh ..... B25B 13/04 81/121.1
2019/0001469 A1 * 1/2019 Cho ..... B25B 23/0035

* cited by examiner

*Primary Examiner* — David B. Thomas

(57) ABSTRACT

A hand tool includes a body which is a cylindrical body and has a hexagonal mounting portion defined in one end thereof. The mounting portion includes six side faces, and each side face includes a function portion which is connected between two contact faces. Six curved recess are defined alternatively between the side faces. Each function portion includes two consecutive V-shaped recesses. The first length is defined between two respective outer ends of the two contact faces of each side face. The mounting hole is defined by an imaginary hexagonal column which includes an axis and six sides. Each side of the imaginary hexagonal column is located corresponding to each contact face. The length of each side is defined as the third length. The first length is 0.5 to 0.65 of the third length.

9 Claims, 10 Drawing Sheets

ENGAGING PORTION FOR A HAND TOOL

BACKGROUND OF THE INVENTION

1. Fields of the Invention

The present invention relates to a hand tool, and more particularly, to an engaging portion of a hand tool such as a socket, to prevent case damage corners of an object when rotating the hand tool.

2. Descriptions of Related Art

A conventional open wrench is shown in FIG. 10 and generally includes a body 40 having two faces 41 and a curved face 42 which is connected between the two faces 41. When the two faces 41 clamp an object 30 and the body 40 is rotated, there are gaps between the object 30 and the two faces 41, such that the corners of the object 30 are worn out by the two faces 41 and become rounded corners.

The present invention intends to provide a socket that includes a hexagonal mounting portion which eliminates the shortcomings mentioned above.

SUMMARY OF THE INVENTION

The present invention relates to a hand tool which comprises a body which is a cylindrical body and has a hexagonal mounting portion defined in one end thereof. The mounting portion includes six side faces, and each side face includes a function portion which is connected between two contact faces. Six curved recess are defined alternatively between the side faces. Each function portion includes two consecutive V-shaped recesses. The first length is defined between two respective outer ends of the two contact faces of each side face. The mounting hole is defined by an imaginary hexagonal column which includes an axis and six sides. Each side of the imaginary hexagonal column is located corresponding to each contact face. The length of each side is defined as the third length. The first length is 0.5 to 0.65 of the third length.

The primary object of the present invention is to provide an engaging portion of a hand tool wherein the engaging portion includes a mounting hole, and the corners of the object that is engaged with the mounting hole are located in the curved recesses of the mounting hole so as not to be worn out.

Preferably, the first length is 0.5 to 0.65 of the third length, so that there is at least 1.75 fourth length between the corner of the object and either end of the contact faces corresponding thereto. Therefore, when the object is rotated by rotating the hand tool, the corners of the object are not worn out.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
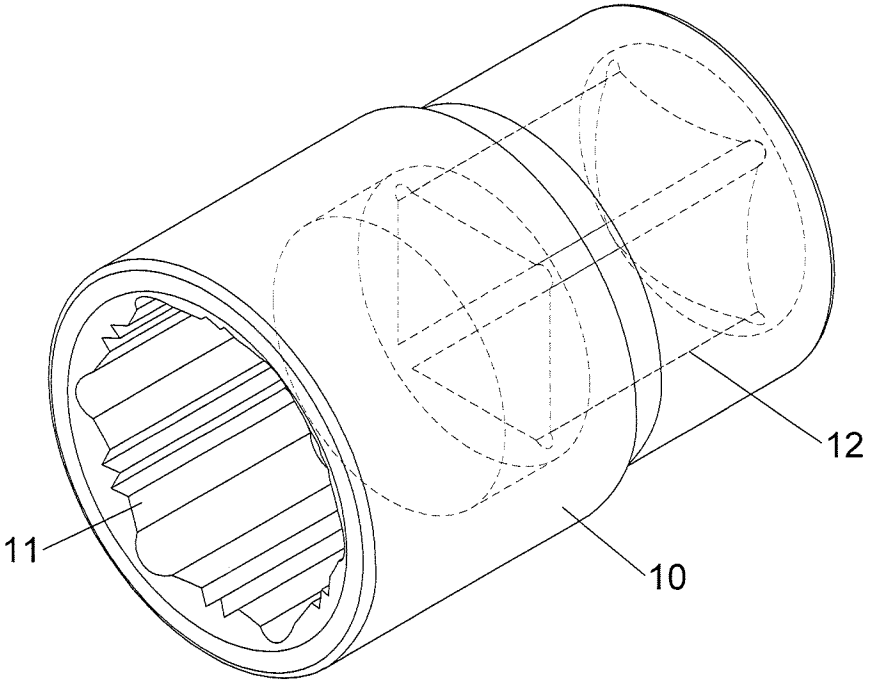
FIG. 1 is a perspective view to show the hand tool of the present invention.
Figure 2:
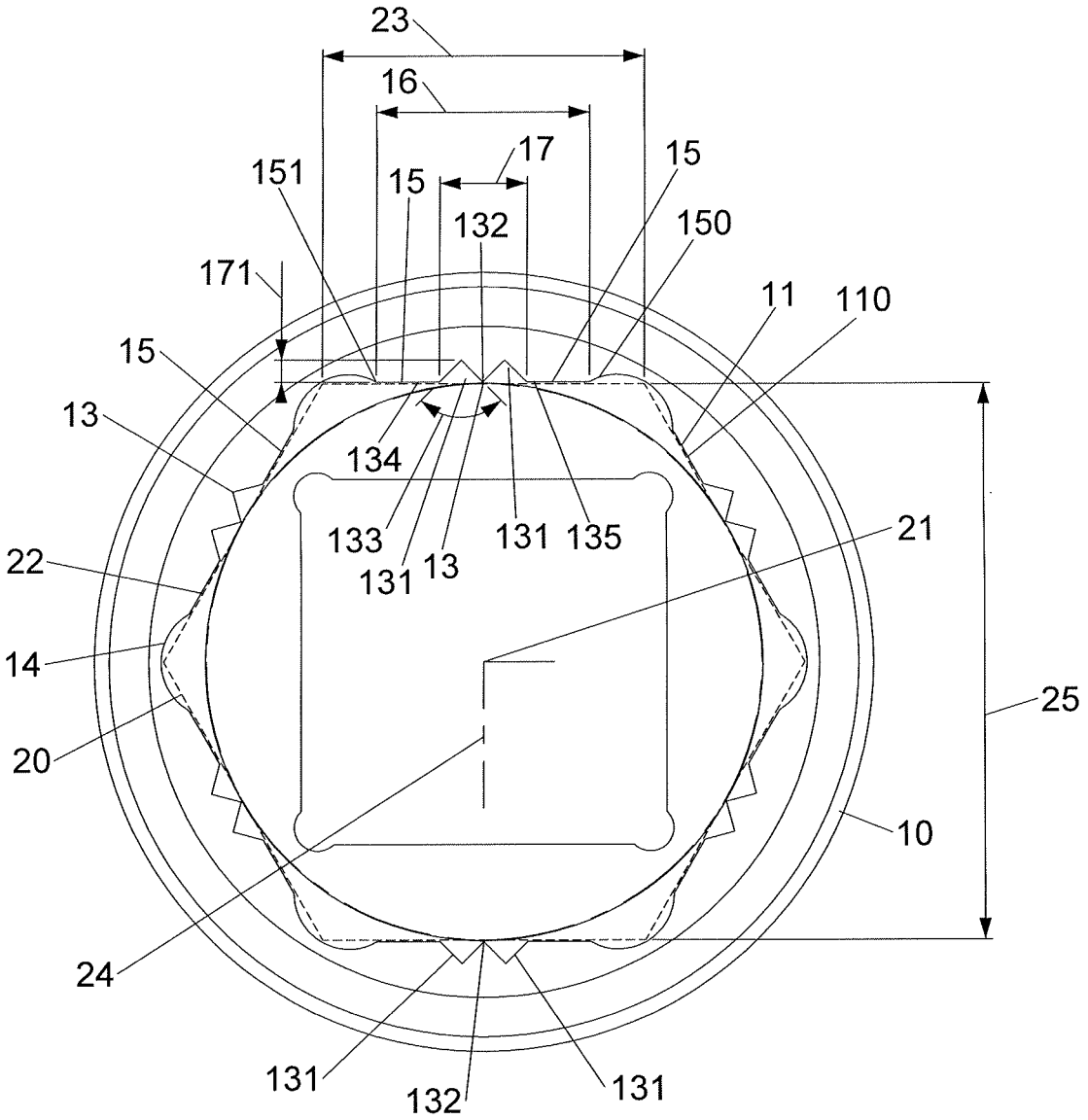
FIG. 2 is an end view of the hand tool of the present invention.

Referring to FIGS. 1 and 2, the hand tool of the present invention comprises a body 10 which is a cylindrical body and has a mounting portion 11 defined in the first end thereof. The mounting portion 11 is a hexagonal recess which includes six side faces 110. Specifically, the mounting hole 11 is defined by an imaginary hexagonal column 20 and the six side faces 110 are located on the side sides of the imaginary hexagonal column 20. The body 10 is a socket and a driving portion 12 is formed on the second end of the body 10. The driving portion 12 has a rectangular recess with which another hand tool can be connected therewith. Each side face 110 has a function portion 13 formed on the central portion thereof. The function portion 13 is connected between two contact faces 15 of each side face 110. Six curved recess 14 are defined alternatively between the side faces 110. Each function portion 13 includes two consecutive recesses 131, and each recess 131 is a V-shaped recess 131 with two equal inclined sides. A peak point 132 is formed between the two consecutive recesses 131 of each side face 110. The peak point 132 of each side face 110 is located on the same plane with the contact faces 15. A first angle 133 is defined between the two equal inclined sides of each recess 131, and the first angle 133 is 90 degrees. A first length 16 is defined between two respective outer ends 150, 151 of the two contact faces 15 of each side face 110. A second length 17 is defined between two respective contact points 134, 135 of the two recesses 131 and the two contact faces 15. Each recess 131 includes a maximum depth 171.

The imaginary hexagonal column 20 includes an axis 21 and six sides 22. Each side 22 of the imaginary hexagonal column 20 is located corresponding to each contact face 15. The length of each side 22 is defined as a third length 23. The first length 16 is 0.5 to 0.65 of the third length 23. When the third length 23 is 10 mm, the first length 16 is 5 mm to 6.5 mm. An imaginary perpendicular line 24 that is perpendicular to the axis 21, and the peak point 132 is located on the perpendicular line 24. The center of each curved recess 14 is located on a connection line passing through the axis 21 and one of six corners of the imaginary hexagonal column 20.

The length between any two facing sides 22 of the imaginary hexagonal column 20 is defined as the fourth length 25. The first length 16 is 0.035 to 0.045 of the fourth length 25. The first length 16 is 0.038 to 0.042 of the fourth length 25.

Figure 3:
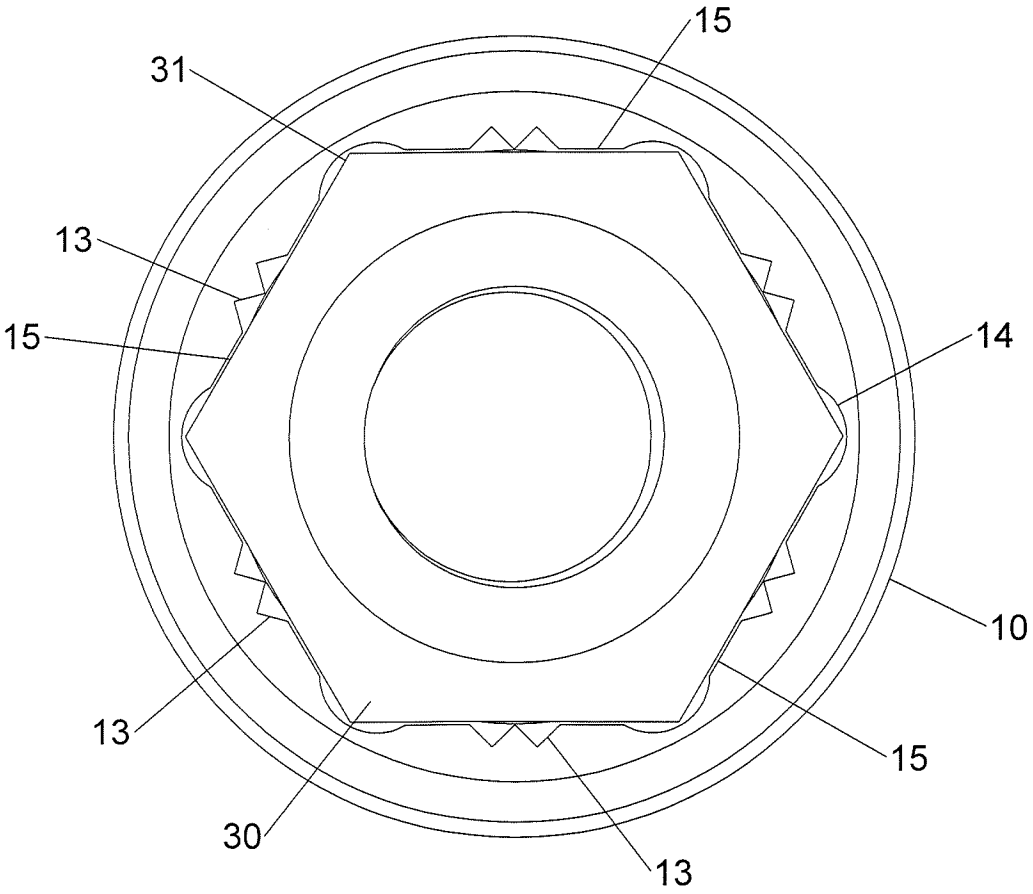
FIG. 3 is an end view of the hand tool of the present invention, wherein an object is engaged with the mounting hole of the hand tool.

As shown in FIG. 3, the object 30 can be accommodated in the mounting hole 11 defined by the imaginary hexagonal column 20. Each corner 31 of the object 30 is located in one of the curved recesses 14 so that when the body 10 is rotated, the corners 31 of the object 30 are not worn out.

Figure 4:
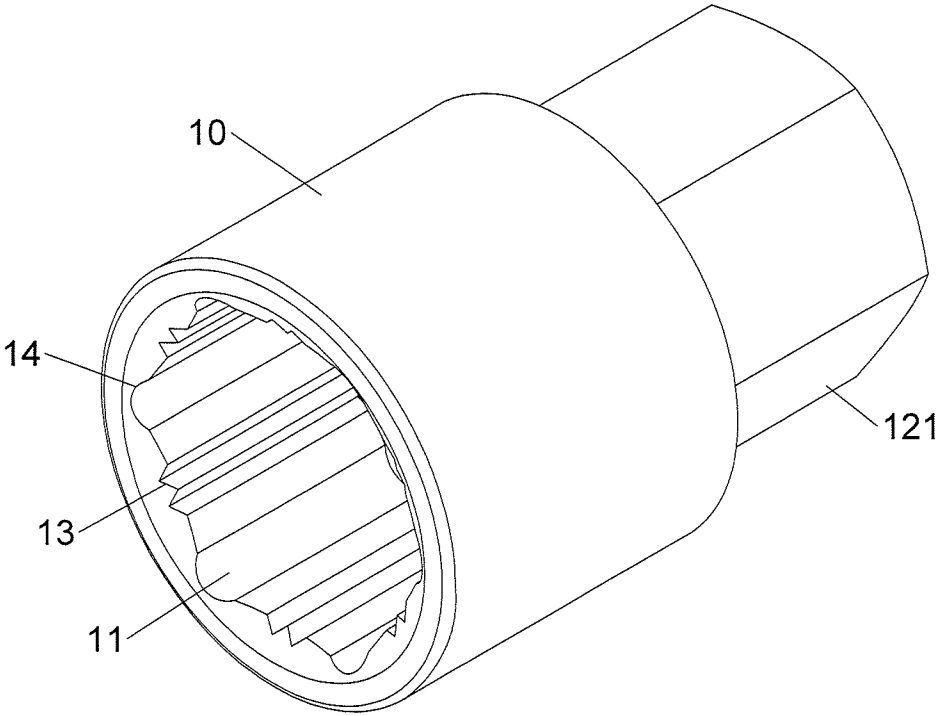
FIG. 4 is a perspective view to show the second embodiment of the hand tool of the present invention.

As shown in FIG. 4, the body 10 is a socket which includes a passage defined axially therethrough.

Figure 5:
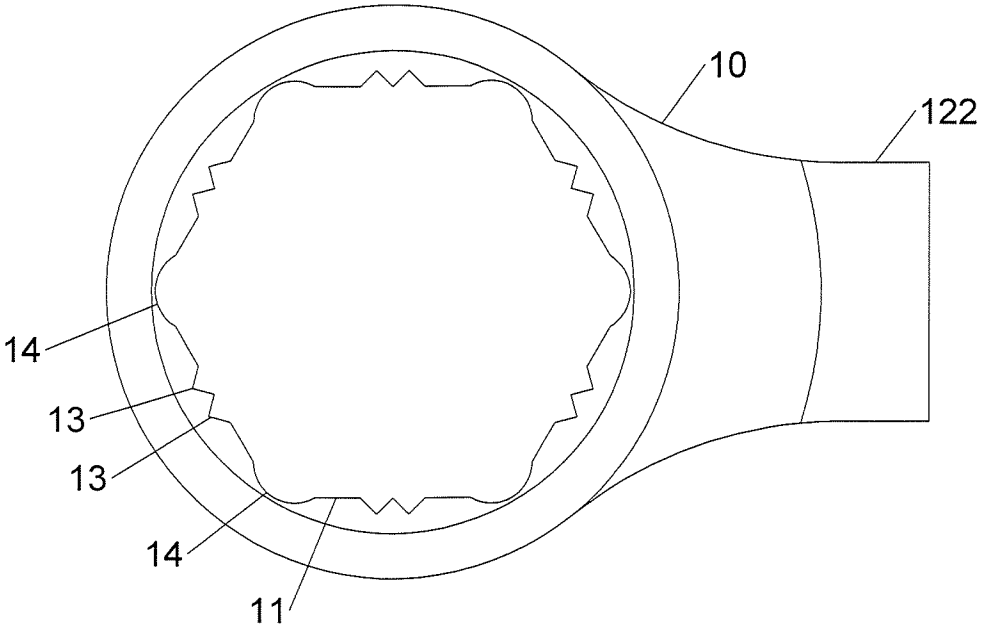
FIG. 5 shows the third embodiment of the hand tool of the present invention.

As shown in FIG. 5, the body 10 is a closed wrench 122.

Figure 6:
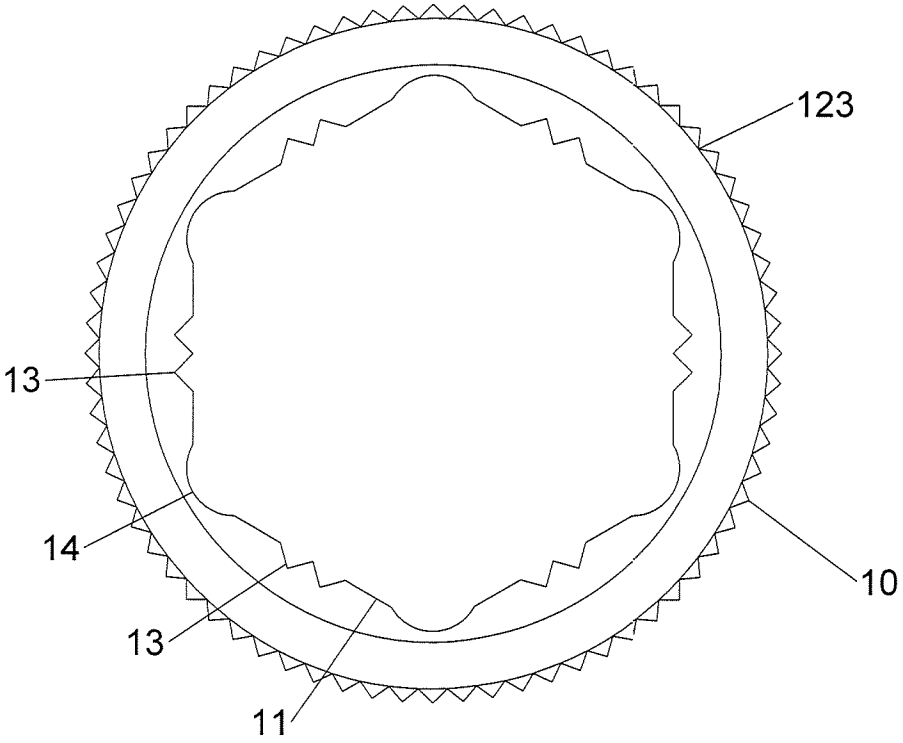
FIG. 6 shows the fourth embodiment of the hand tool of the present invention.

As shown in FIG. 6, the body 10 is a ratchet mechanism 123.

Figure 7:
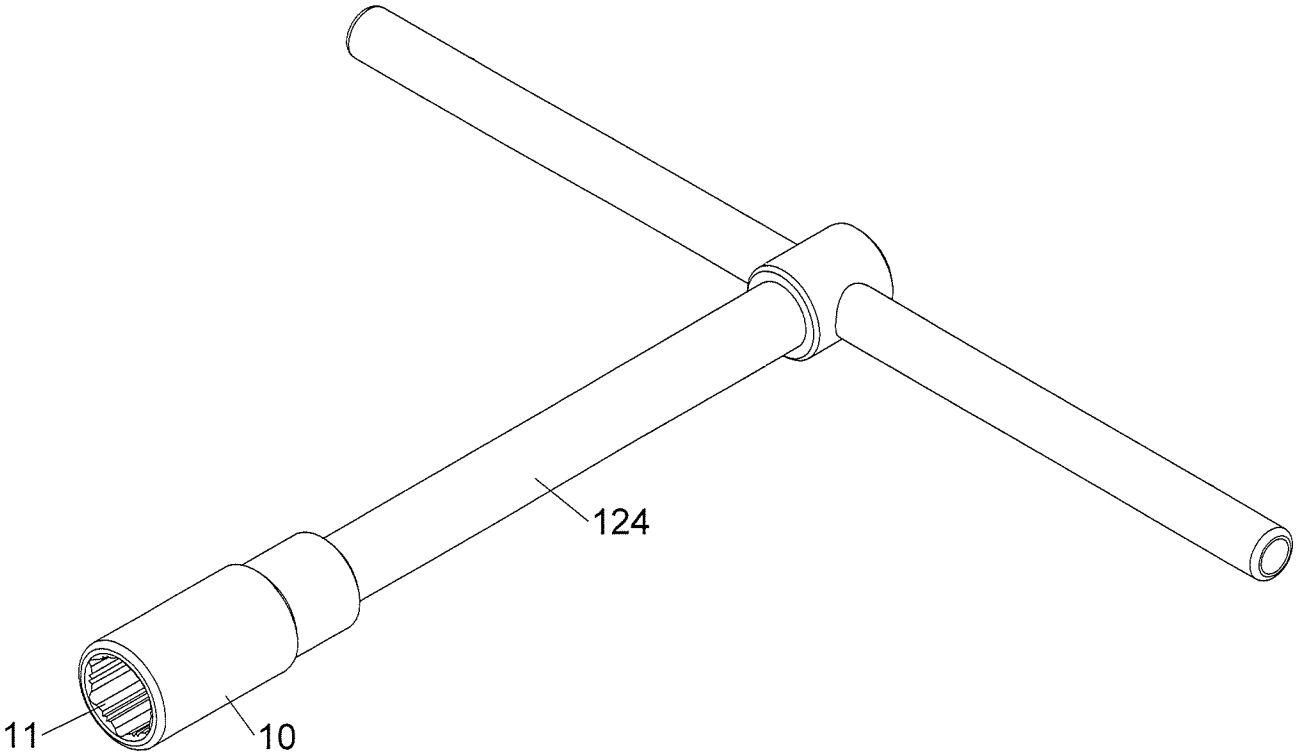
FIG. 7 shows the fifth embodiment of the hand tool of the present invention.

As shown in FIG. 7, the body 10 is a first rod 124.

Figure 8:
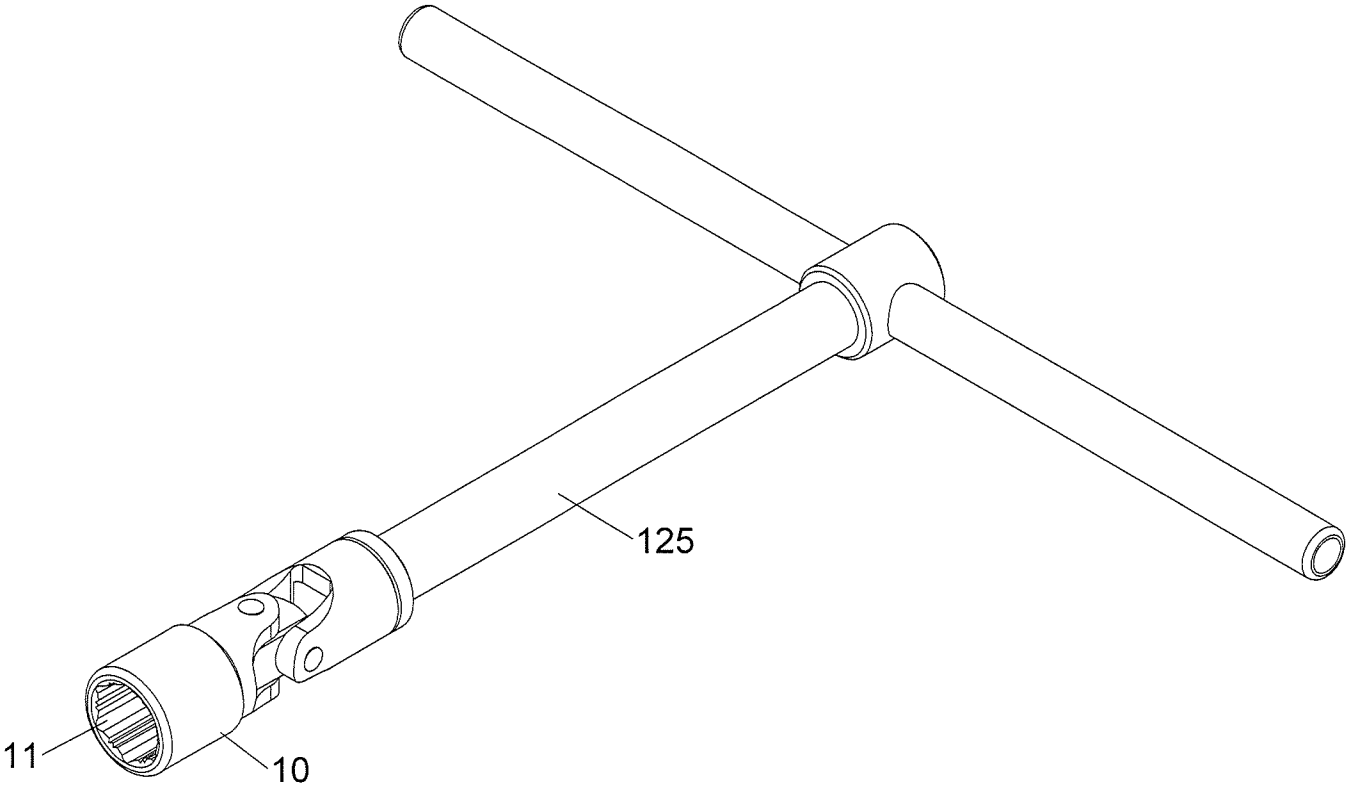
FIG. 8 shows the sixth embodiment of the hand tool of the present invention.

As shown in FIG. 8, the body 10 is a second rod 125 having a universal connector 126 connected thereto.

Figure 9:
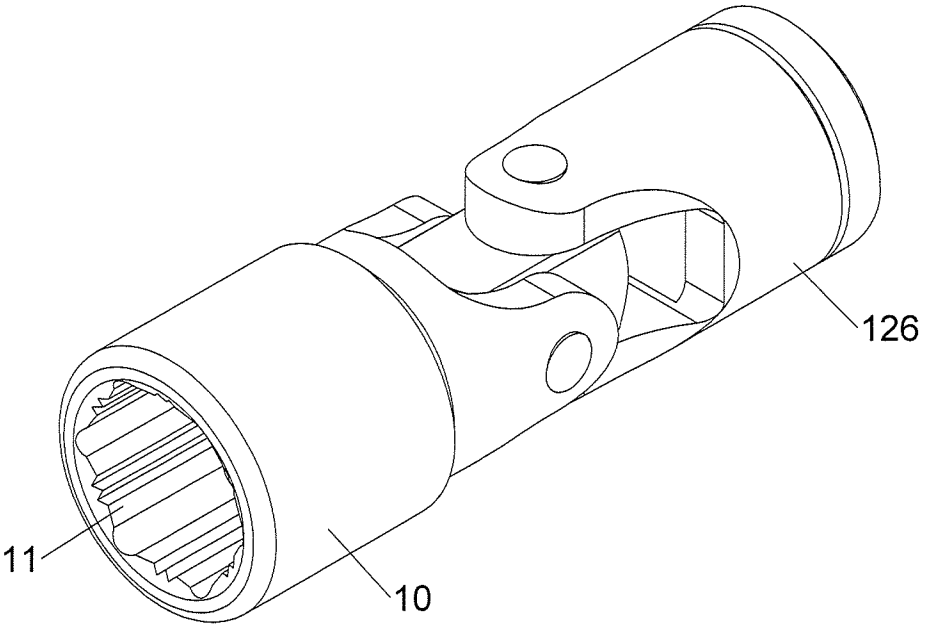
FIG. 9 shows the seventh embodiment of the hand tool of the present invention.
Figure 10:
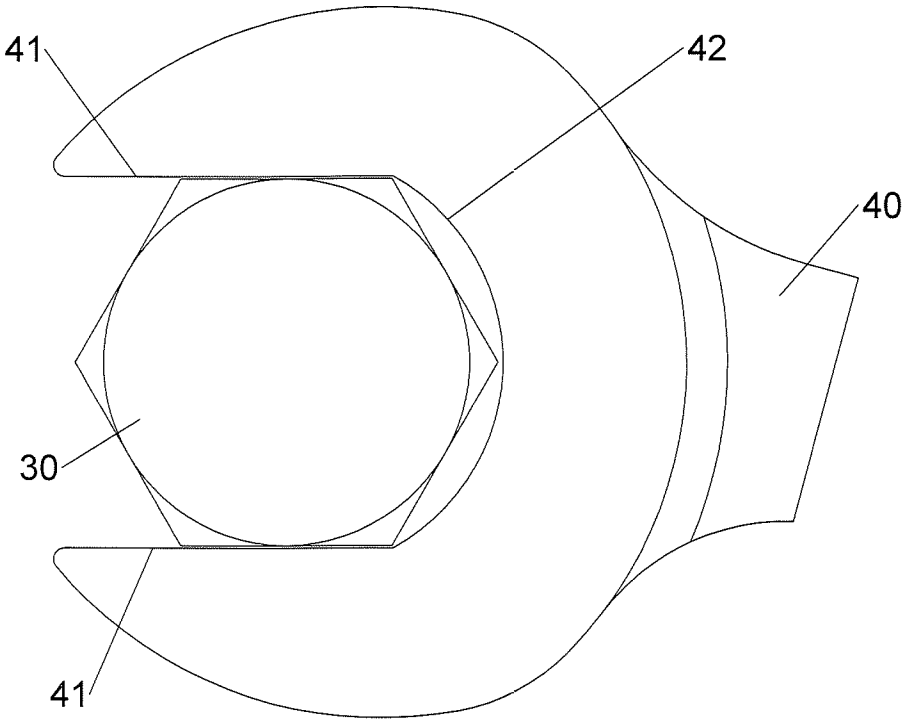
PRIOR ART FIG.10
FIG. 10 shows the conventional hand tool with the object being engaged with the conventional hand tool.

As shown in FIG. 9, the body 10 is a universal connector 126.

The advantages of the present invention are that each corner 31 of the object 30 is located in one of the curved recesses 14 so that when the body 10 is rotated, the corners 31 of the object 30 are not worn out.

The first length 16 is defined between two respective outer ends 150, 151 of the two contact faces 15 of each side face 110. The length of each side 22 is defined as a third length 23. The first length 16 is 0.5 to 0.65 of the third length 23. There is at least 1.75 fourth length between the corner 31 of the object 30 and either end of the contact faces 15 corresponding thereto. Therefore, when the object 30 is rotated by rotating the hand tool, the corners 31 of the object 30 are not worn out.

While we have shown and described the embodiment in accordance with the present invention, it should be clear to those skilled in the art that further embodiments may be made without departing from the scope of the present invention.

What is claimed is:

1. A hand tool comprising:

a body being a cylindrical body and having a mounting portion defined in a first end thereof, the mounting portion being a hexagonal recess which includes six side faces, each side face having a function portion formed on a central portion thereof, the function portion connected between two contact faces of each side face, six curved recess defined alternatively between the side faces, each function portion including two consecutive recesses, each recess being a V-shaped recess with two equal inclined sides, a first angle defined between the two equal inclined sides of each recess and the first angle being 90 degrees, a peak point formed between the two consecutive recesses of each side face, the peak point of each side face being located on the same plane with the contact faces, a first length being defined between two respective outer ends of the two contact faces of each side face, a second length being defined between two respective contact points of the two recesses and the two contact faces;

the mounting hole being defined by an imaginary hexagonal column which includes an axis and six sides, each side of the imaginary hexagonal column located corresponding to each contact face, a length of each side being defined as a third length, the first length being 0.5 to 0.65 of the third length, an imaginary perpendicular line that is perpendicular to the axis, the peak point located on the perpendicular line, a center of each curved recess located on a connection line passing through the axis and one of six corners of the imaginary hexagonal column, and a length between any two facing sides of the imaginary hexagonal column being defined as a fourth length, the first length being 0.035 to 0.045 of the fourth length.

2. The hand tool as claimed in claim 1, wherein the body is a socket and a driving portion is formed on a second end of the body, the driving portion has a rectangular recess.

3. The hand tool as claimed in claim 1, wherein the first length is 0.038 to 0.042 of the fourth length.

4. The hand tool as claimed in claim 1, wherein the body is a socket which includes a passage defined axially therethrough.

5. The hand tool as claimed in claim 1, wherein the body is a closed wrench.

6. The hand tool as claimed in claim 1, wherein the body is a ratchet mechanism.

7. The hand tool as claimed in claim 1, wherein the body is a first rod.

8. The hand tool as claimed in claim 1, wherein the body is a second rod having a universal connector connected thereto.

9. The hand tool as claimed in claim 1, wherein the body is a universal connector.

* * * * *